US009641932B2

(12) United States Patent
Li

(10) Patent No.: US 9,641,932 B2
(45) Date of Patent: May 2, 2017

(54) AUDIO SIGNAL ADAPTER DEVICE, INTERFACE DETECTING SYSTEM OF THE SAME AND ELECTRONIC SIGNATURE TOKEN

(71) Applicant: Tendyron Corporation, Beijing (CN)

(72) Inventor: Dongsheng Li, Beijing (CN)

(73) Assignee: Tendyron Corporation (CN)

( * ) Notice: Subject to any disclaimer, the term of this patent is extended or adjusted under 35 U.S.C. 154(b) by 28 days.

(21) Appl. No.: 14/428,160

(22) PCT Filed: Jun. 14, 2013

(86) PCT No.: PCT/CN2013/077234

§ 371 (c)(1),
(2) Date: Mar. 13, 2015

(87) PCT Pub. No.: WO2014/040435

PCT Pub. Date: Mar. 20, 2014

(65) Prior Publication Data

US 2015/0249883 A1 Sep. 3, 2015

(30) Foreign Application Priority Data

Sep. 13, 2012 (CN) ..... 2012 1 0340261

(51) Int. Cl.
*H04R 3/00* (2006.01)
*H04R 1/08* (2006.01)
*H04R 29/00* (2006.01)

(52) U.S. Cl.
CPC ..... *H04R 3/00* (2013.01); *H04R 1/08* (2013.01); *H04R 3/007* (2013.01); *H04R 29/00* (2013.01)

(58) Field of Classification Search
None
See application file for complete search history.

(56) References Cited

U.S. PATENT DOCUMENTS

2003/0165233 A1* 9/2003 Veitch ..... H04M 1/738 379/399.01
2003/0179892 A1* 9/2003 Madsen ..... H03F 3/68 381/120

(Continued)

FOREIGN PATENT DOCUMENTS

CN 101937039 A 1/2011
CN 102354883 A 2/2012

(Continued)

OTHER PUBLICATIONS

International Search Report for Application No. PCT/CN2013/077234 dated Sep. 19, 2013.

*Primary Examiner* — Curtis Kuntz
*Assistant Examiner* — Qin Zhu
(74) *Attorney, Agent, or Firm* — Lerner, David, Littenberg, Krumholz & Mentlik, LLP

(57) ABSTRACT

An audio signal adapter device detects whether a sequence of a microphone pin and a ground pin of an apparatus with an audio plug matches a detecting device into which the audio plug is inverted. The device includes a first interface having an audio signal receiving pin, a microphone pin and a ground pin, and a second interface having an audio signal output pin. An audio signal amplifying circuit is configured to amplify an audio signal received by the audio signal receiving pin and to output the amplified audio signal to the audio signal output pin. The audio signal received by the audio signal receiving pin flows to the microphone pin or ground pin via an impedance equivalent part of an audio signal amplifying circuit. The impedance circuit is coupled between the microphone pin and ground pin. An interface detecting system and an electronic signature token are also provided.

17 Claims, 4 Drawing Sheets

(56) References Cited

U.S. PATENT DOCUMENTS

| | | | | |
|---|---|---|---|---|
| 2004/0190384 | A1 | 9/2004 | Hsieh et al. | |
| 2007/0049103 | A1* | 3/2007 | Kashi | H01R 24/58 439/396 |
| 2010/0128900 | A1* | 5/2010 | Johnson | H03G 3/001 381/98 |
| 2010/0215183 | A1* | 8/2010 | Hansson | H04R 1/1033 381/58 |
| 2011/0098085 | A1* | 4/2011 | Stenmark | H04M 1/72527 455/557 |
| 2013/0266146 | A1* | 10/2013 | Miao | H04R 1/1041 381/28 |
| 2013/0329897 | A1* | 12/2013 | Breece, III | H04R 29/00 381/59 |
| 2014/0075210 | A1* | 3/2014 | Rich | G06F 1/1632 713/300 |

FOREIGN PATENT DOCUMENTS

| | | |
|---|---|---|
| CN | 102883255 | 1/2013 |
| CN | 202799156 U | 3/2013 |
| CN | 103220598 A | 7/2013 |

* cited by examiner

AUDIO SIGNAL ADAPTER DEVICE, INTERFACE DETECTING SYSTEM OF THE SAME AND ELECTRONIC SIGNATURE TOKEN

CROSS-REFERENCE TO RELATED APPLICATIONS

The present application is a national phase entry under 35 U.S.C. §371 of International Application No. PCT/CN2013/077234 filed Jun. 14, 2013, which claims priority from Chinese Patent Application No. 201210340261.9 filed Sep. 13, 2012 all of which are incorporated herein by reference.

FIELD

The present disclosure relates to an electronic technology field, and more particularly to an audio signal adapter device, a detecting device, an electronic signature token having the audio signal adapter device, and an interface detecting system for the audio signal adapter device.

BACKGROUND

In the related art, there are two types of four-section headphones. For one type, the pins of the headphone plug are arranged in a sequence of an audio channel output pin (a left-channel and a right-channel), a microphone pin and a ground pin. For the other type, the pins of the headphone plug are arranged in a sequence of a channel output pin (a left-channel and a right-channel), a ground pin and a microphone pin. For the headphone plug of a three-section headphone, a channel output pin is a single-channel, and a sequence of a microphone pin and a ground pin is also divided into the above two types. The sequence of the microphone pin and the ground pin in the audio plug is different, which may cause a mismatch between different types of audio plugs and the sockets disposed in electronic apparatus. At present, there is neither professional detecting device which is capable of distinguishing the type of the audio plug, nor audio plug detectable by the detecting device to distinguish the type of the audio plug.

SUMMARY

The present disclosure seeks to solve at least one of above technical problems.

Accordingly, a first objective of the present disclosure is to provide an audio signal adapter device which may detect whether a sequence of a microphone pin and a ground pin of an apparatus with an audio plug matches a detecting device into which the audio plug is inverted.

A second objective of the present disclosure is to provide an electronic signature token.

A third objective of the present disclosure is to provide a detecting device.

A fourth objective of the present disclosure is to provide an interface detecting system of an audio signal adapter device.

In order to realize the above objectives, embodiments of a first aspect of the present disclosure provide an audio signal adapter device. The device comprises: a first interface, a second interface, an audio signal amplifying circuit and an impedance circuit. The first interface comprises an audio signal receiving pin, a microphone pin and a ground pin, the second interface comprises an audio signal output pin, the audio signal amplifying circuit is configured to amplify an audio signal received by the audio signal receiving pin and to output the amplified audio signal to the audio signal output pin; the audio signal received by the audio signal receiving pin flows to the microphone pin or the ground pin via an impedance equivalent part of the audio signal amplifying circuit; the impedance circuit is coupled between the microphone pin and the ground pin.

With the audio signal adapter device according to embodiments of the present disclosure, since the audio signal received by the audio signal receiving pin flows to the microphone pin or the ground pin via the impedance equivalent part of the audio signal amplifying circuit, which ensures a symmetric arrangement of the microphone pin and the ground pin. In cases a sequence of the ground pin and the microphone pin is unknown, the audio signal received by the audio signal receiving pin may be transmitted to the ground pin and form a loop circuit with a detecting device (e.g., a mobile phone), without affecting a transmission of the audio signal from the audio signal receiving pin to the audio signal output pin of the audio signal adapter device.

Furthermore, the second interface further comprises an audio signal input pin.

Furthermore, the audio signal adapter device further comprises a first circuit and a second circuit. The first circuit is coupled between the microphone pin and the audio signal input pin, the second circuit is coupled between the ground pin and the audio signal input pin, and the first circuit and the second circuit are attenuation circuits for each other.

Furthermore, the first circuit is a filter circuit or a voltage-dividing circuit; the second circuit is a filter circuit or a voltage-dividing circuit.

Furthermore, the first circuit and the second circuit are symmetric attenuation circuits or asymmetric attenuation circuits for each other.

Therefore, mutual attenuation circuits coupled between the audio signal input pin and the microphone pin and between the audio signal input pin and the ground pin respectively ensures a symmetric arrangement of the microphone pin and the ground pin. Therefore, in the case a sequence of the ground pin and the microphone pin is unknown, the audio signal input by the audio signal input pin is transmitted to the ground pin, thus realizing a transmission of an audio uplink signal.

Furthermore, the audio signal amplifying circuit comprises at least one selected from a group consisting of: a transformer, a resistor and an operational amplifier connected in parallel, an inductor and an operational amplifier connected in parallel, a resistor and a comparator connected in parallel, and an inductor and a comparator connected in parallel.

Furthermore, embodiments of a second aspect of the present disclosure provide an electronic signature token. The electronic signature token comprises: the audio signal adapter device according to embodiments of the first aspect and a master control chip. The master control chip comprises an audio signal receiving unit and an audio signal sending unit; the audio signal receiving unit is coupled with the audio signal output pin of the audio signal adapter device; and the audio signal sending unit is coupled with the audio signal input pin of the audio signal adapter device.

With the electronic signature token according to embodiments of the present disclosure, the audio signal adapter device is used, which may realize a successful uplink or downlink transmission of an audio signal, and a signal transmission quality is ensured. An apparatus (e.g., a mobile phone) which matches the electronic signature token and performs a transaction in an audio mode may intercommunicate with the electronic signature token via an audio plug, thus improving a function of the audio interface and extending an application range of the audio interface.

Furthermore, embodiments of a third aspect of the present disclosure provide a detecting device. The device comprises a detecting interface and a detecting unit. The detecting interface comprises a detecting signal output pin, a ground pin and a detecting pin, and adapts to the first interface of the audio signal adapter device according to embodiments of the first aspect so as to detect the first interface; when the ground pin of the detecting interface is coupled with the microphone pin of the audio signal adapter device, the detecting unit is configured to determine a mismatch between the first interface and the detecting interface according to an analog signal received by the detecting pin.

The detecting device according to embodiments of the present disclosure may be used to determine whether a pin sequence of the audio interface of an apparatus matches that of the detecting interface, and thus it is favorable for subsequent operations.

Furthermore, embodiments of a fourth aspect of the present disclosure provide an interface detecting system of an audio signal adapter device. The system comprises the audio signal adapter device according to embodiments of the first aspect and the detecting device according to embodiments of the third aspect.

With the interface detecting system of the audio signal adapter device according to embodiments of the present disclosure, whether a pin sequence of the audio interface matches that of the interface of the detecting device may be detected. If the pin sequence of the audio interface matches that of the interface of the detecting device, a detecting result is not generated; and if the pin sequence of the audio interface mismatches that of the interface of the detecting device, the detecting result is generated, thus making the detection simple and convenient.

Furthermore, the interface detecting system of the audio signal adapter device further comprises a master control chip coupled with the audio signal adapter device. The master control chip comprises an audio signal receiving unit and an audio signal sending unit; the audio signal receiving unit is coupled with the audio signal output pin of the audio signal adapter device; and the audio signal sending unit is coupled with the audio signal input pin of the audio signal adapter device.

Therefore, the interface detecting system may detect a pin sequence of the audio interface of an electronic signature token having the audio signal adapter device, thus extending a range of detection.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
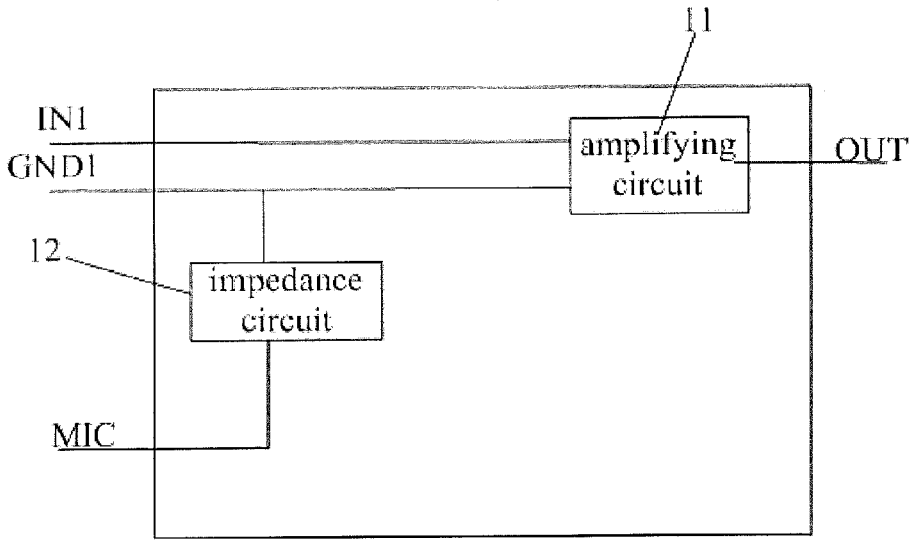
FIG. 1 is a schematic diagram of an audio signal adapter device according to an embodiment of the present disclosure.

Reference will be made in detail to embodiments of the present disclosure. Examples of the embodiments are illustrated in drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the description of the present invention, it is to be understood that, terms such as "first" and "second" are used herein for purposes of description and are not intended to indicate or imply relative importance or significance. In the description of the present invention, it is to be illustrated that, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures, which can be understood by those skilled in the art according to specific situations. In the description of the present invention, "a plurality of" means two or more than two, unless specified otherwise.

Any process or method described in a flow chart or described herein in other ways may be understood to include one or more modules, segments or portions of codes of executable instructions for achieving specific logical functions or steps in the process, and the scope of a preferred embodiment of the present disclosure includes other implementations, in which functions may be executed not in the order shown or discussed but simultaneously or in reverse order based on the related functions. This should be understood by those skilled in the art.

An audio signal adapter device according to embodiments of the present disclosure will be described below with reference to drawings.

Embodiment 1

FIG. 1 shows an audio signal adapter device according to an embodiment of the present disclosure. Referring to FIG. 1, the audio signal adapter device comprises a first interface, a second interface, an audio signal amplifying circuit 11 and an impedance circuit 12.

The first interface comprises an audio signal receiving pin IN1, a ground pin GND1 and a microphone pin MIC. The audio signal receiving pin IN1 is a single-channel pin in a single-channel audio plug, or one of a left-channel pin and a right-channel pin in a stereo audio plug. Since a relative position between the ground pin GND1 and the microphone pin MIC is undetermined temporarily, in following description, positions of the ground pin GND1 and the microphone pin MIC may be exchanged. For purpose of convenience, in the present embodiment and other embodiments, the relative positions between the ground pin GND1 and the microphone pin MIC all refer to that shown in FIG. 1, which may not be understood to limit the present disclosure.

The second interface comprises an audio signal output pin OUT.

The audio signal amplifying circuit 11 is configured to amplify an audio signal received by the audio signal receiving pin and to output the amplified audio signal to the audio signal output pin OUT. Referring to FIG. 1, The audio signal received by the audio signal receiving pin IN1 flows to the microphone pin MIC or the ground pin GND1 via an impedance equivalent part of the audio signal amplifying circuit 11, which ensures a symmetric arrangement of the microphone pin MIC and the ground pin GND1. Therefore, in the case a sequence of the ground pin GND1 and the microphone pin MIC is unknown, the audio signal received by the audio signal receiving pin IN1 may be transmitted to the microphone pin MIC and the ground pin GND1 simultaneously, thus ensuring the detecting device (not shown in FIG. 1) may form a loop circuit with the impedance equivalent part of the audio signal amplifying circuit 11 of the audio signal adapter device, without affecting a transmission of the audio signal from the audio signal receiving pin IN1 to the audio signal output pin OUT of the audio signal adapter device.

The impedance circuit 12 is coupled between the ground pin GND1 and the microphone pin MIC to prevent a short circuit between the microphone pin MIC and the ground pin GND1.

With the audio signal adapter device according to embodiments of the present disclosure, since the audio signal received by the audio signal receiving pin flows to the microphone pin or the ground pin via the impedance equivalent part of the audio signal amplifying circuit, which ensures a symmetric arrangement of the microphone pin and the ground pin. Therefore, in the case a sequence of the ground pin and the microphone pin is unknown, the audio signal received by the audio signal receiving pin may be transmitted to the ground pin and form a loop circuit with a detecting device (e.g., a mobile phone), without affecting a transmission of the audio signal from the audio signal receiving pin to the audio signal output pin of the audio signal adapter device.

Embodiment 2

Figure 2:
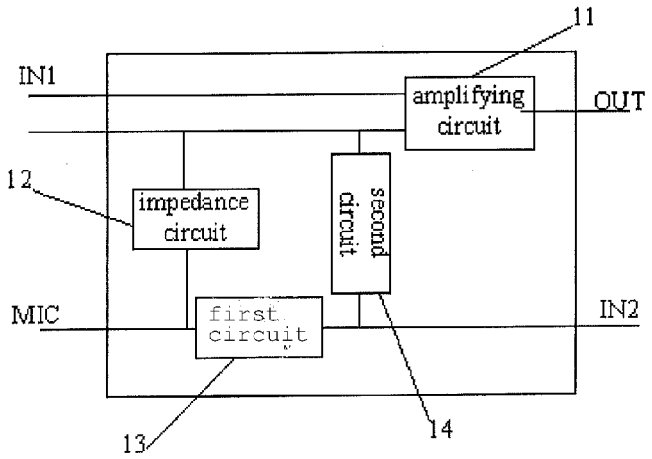
FIG. 2 is a schematic diagram of an audio signal adapter device according to another embodiment of the present disclosure.

FIG. 2 is a schematic diagram of an audio signal adapter device according to another embodiment of the present disclosure. Referring to FIG. 2, Embodiment 2 differs from Embodiment 1 in that the second interface shown in this embodiment may further comprise an audio signal input pin IN2. Parts in FIG. 2 which are the same as those in Embodiment 1 are marked with same numbers. The same marking regulation is applied to following embodiments.

Specifically, the audio signal adapter device may further comprise a first circuit 13 and a second circuit 14.

The first circuit 13 is coupled between the microphone pin MIC and the audio signal input pin IN2, the second circuit 14 is coupled between the ground pin GND1 and the audio signal input pin IN2, and the first circuit 13 and the second circuit 14 are attenuation circuits for each other.

Furthermore, the first circuit 13 is a filter circuit or a voltage-dividing circuit; and the second circuit 14 is a filter circuit or a voltage-dividing circuit.

Furthermore, the first circuit 13 and the second circuit 14 are symmetric attenuation circuits or asymmetric attenuation circuits for each other.

Therefore, mutual attenuation circuits are coupled between the audio signal input pin and the microphone pin and between the audio signal input pin and the ground pin respectively, which ensures a symmetric arrangement of the microphone pin and the ground pin, such that in the case that a sequence of the ground pin and the microphone pin is unknown, the audio signal input by the audio signal input pin is transmitted to the ground pin, thus realizing a transmission of an audio uplink signal.

Figure 3:
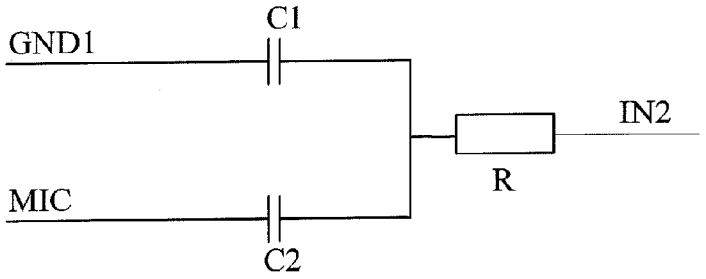
FIG. 3 is a schematic diagram of a first circuit and a second circuit of an audio signal adapter device according to an embodiment of the present disclosure.

FIG. 3 is a schematic diagram of the first circuit and the second circuit 14 of the audio signal adapter device according to a specific example of this embodiment. The symmetric attenuation filter circuits are used in this example. Referring to FIG. 3, the ground pin GND1 is connected with the audio signal input pin IN2 via a first capacitor C1 and a resistor R, and the microphone pin MIC is connected with the audio signal input pin IN2 via a second capacitor C2 and the resistor R.

In this case, the audio uplink signal sent by the audio signal input pin IN2 is filtered by the first capacitor C1 and the resistor R and by the second capacitor C2 and the resistor R, such that an amplitude of the audio uplink signal sent by an audio uplink signal generating device is decreased, and the audio uplink signal may be transmitted to the ground pin GND1 and the microphone pin MIC with unknown sequence simultaneously, and thus ensuring the audio uplink signal to be sent to the microphone pin MIC so as to realize an uplink transmission of the audio signal.

Apparently, when the microphone pin MIC and the ground pin GND1 are exchanged, the uplink transmission of the audio signal may also be realized.

In this example, a capacitance of the first capacitor C1 may range from 100 pF to 100 uF, a capacitance of the second capacitor C2 may range from 100 pF to 100 uF. A resistance of the resistor R may range from 10 KΩ to 500 KΩ, preferably from 50 KΩ to 100 KΩ.

It can be known that, no matter what the sequence of the ground pin GND1 and the microphone pin MIC is, the uplink transmission of the audio signal may be realized by the circuit illustrated in this example.

The first circuit 13 and the second circuit 14 mentioned in this example may also have other forms, for example, the first capacitor C1 and/or the second capacitor C2 may be replaced with a resistor, or the resistor R may be replaced with a capacitor. This example may be extended with reference to the related art, and what is known in the related art will not be described in detail herein.

Embodiment 3

The audio signal amplifying circuit 11 mentioned in Embodiment 1 may comprises at least one selected from a group consisting of: a transformer, a resistor and an operational amplifier connected in parallel, an inductor and an operational amplifier connected in parallel, a resistor and a comparator connected in parallel, and an inductor and a comparator connected in parallel, etc.

Figure 4:
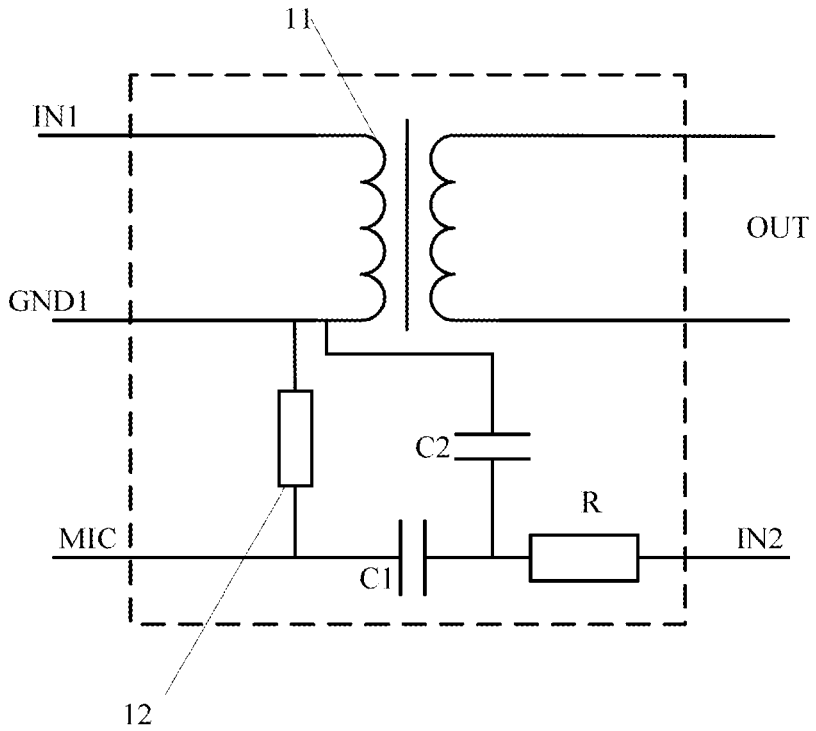
FIG. 4 is a schematic diagram of an audio signal adapter device according to yet another embodiment of the present disclosure.

An example using the transformer 11 for amplifying the audio signal is taken as an example to illustrate the present disclosure. Referring to FIG. 4, a primary coil of the transformer 11 is connected with the audio signal receiving pin IN1 and the ground pin GND1, and a secondary coil of the transformer 11 is connected with the audio signal output pin OUT.

Since the transformer 11 is a passive device, it has no power consumption while working.

Furthermore, by using the transformer 11 to amplify an audio signal, a common mode between different apparatus interfaces has been solved.

Using the transformer to amplify an audio signal is merely a particular embodiment of the present disclosure rather than being a limit to the present disclosure. Other amplifying circuits which are known in the related art will not described in detail herein.

Furthermore, as shown in FIG. 4, the impedance circuit comprises one resistor. Certainly, the impedance circuit may also comprise an inductor or other element for preventing a short circuit between the ground pin GND1 and the microphone pin MIC.

A detecting device according to embodiments of the present disclosure will be described below with reference to drawings.

Figure 5:
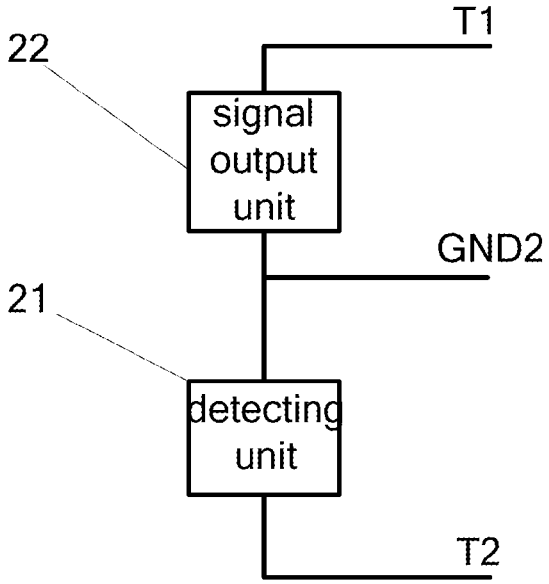
FIG. 5 is a schematic diagram of a detecting device according to an embodiment of the present disclosure.

As shown in FIG. 5, the detecting device comprises a detecting interface and a detecting unit 21. The detecting interface comprises a detecting signal output pin T1, a ground pin GND2 and a detecting pin T2. A detecting signal is output from a signal output unit 22 to the detecting signal output pin T1. The detecting interface adapts to the first interface of the audio signal adapter device described above so as to complete the detection on the first interface. Specifically, referring to FIG. 7 or FIG. 8, the detecting signal output pin T1 is connected with the audio signal receiving pin IN1 of the audio signal adapter device described above, the ground pin GND2 of the detecting interface is connected with one of the ground pin GND1 and the microphone pin MIC of the audio signal adapter device described above, and the detecting pin T2 is connected with the other one of the ground pin GND1 and the microphone pin MIC of the audio signal adapter device described above.

The detecting device according to embodiments of the present disclosure may be used to determine whether a pin sequence of the audio interface of an apparatus matches that of the detecting interface, and thus it is favorable for a subsequent operation.

Figure 6:
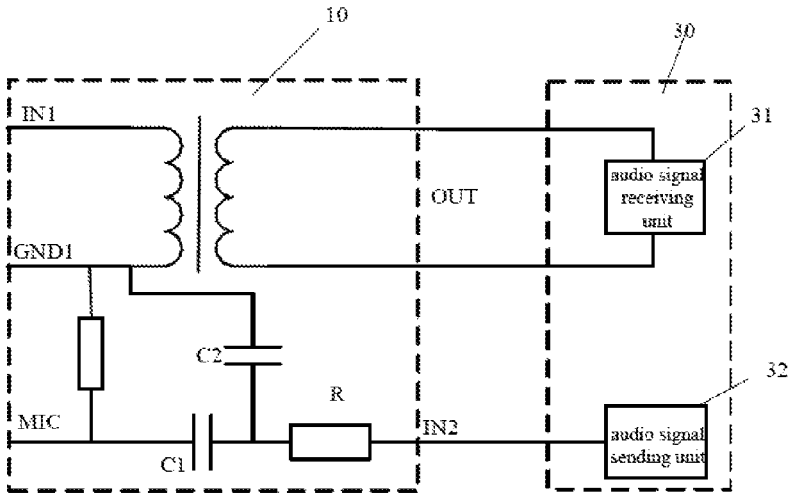
FIG. 6 is a schematic diagram of an electronic signature token according to an embodiment of the present disclosure.

As shown in FIG. 6, the electronic signature token comprises the audio signal adapter device 10 according to above embodiments and a master control chip 30.

The master control chip 30 comprises an audio signal receiving unit 31 and an audio signal sending unit 32.

Specifically, the audio signal receiving unit 31 is coupled with the audio signal output pin OUT of the audio signal adapter device 10.

The audio signal sending unit 32 is coupled with the audio signal input pin IN2 of the audio signal adapter device 10.

With the electronic signature token according to embodiments of the present disclosure, the audio signal adapter device is used, which may realize a successful uplink or downlink transmission of an audio signal, and a signal transmission quality is ensured. An apparatus (e.g., a mobile phone) which matches the electronic signature token and performs a transaction in an audio mode may intercommunicate with the electronic signature token via an audio plug, thus improving a function of the audio interface and extending an application range of the audio interface.

An interface detecting system of an audio signal adapter device according to embodiments of the present disclosure will be described below with reference to drawings.

Embodiment 1

Figure 7:
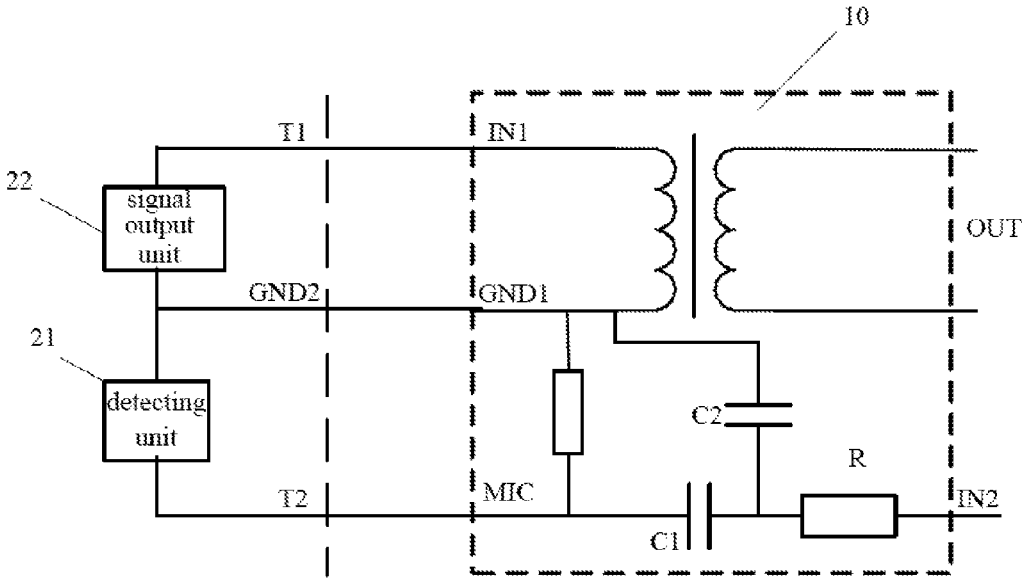
FIG. 7 is a schematic diagram of an interface detecting system of an audio signal adapter device according to an embodiment of the present disclosure.

As shown in FIG. 7, the interface detecting system of the audio signal adapter device comprises the audio signal adapter device 10 according to above embodiments and the detecting device according to above embodiments.

A detecting method of the detecting system according to one embodiment of the present disclosure is described herein briefly.

Referring to FIG. 7, when a ground pin GND2 of the detecting interface is connected with a ground pin GND1 of the audio signal adapter device and a detecting pin T2 of the detecting interface is connected with a microphone pin MIC of the audio signal adapter device, a signal output pin T1 of the detecting interface outputs a detecting signal to an audio signal receiving pin IN1 of the audio signal adapter device. The detecting signal directly flows to the ground pin GND1 of the audio signal adapter device 10 via an impedance equivalent part of the audio signal amplifying circuit of the audio signal adapter device, and flows to the ground pin GND2 of the detecting interface. In this case, a detecting unit 21 fails to receive the detecting signal, which indicates that a first interface of the audio signal adapter device 10 matches the detecting interface.

Figure 8:
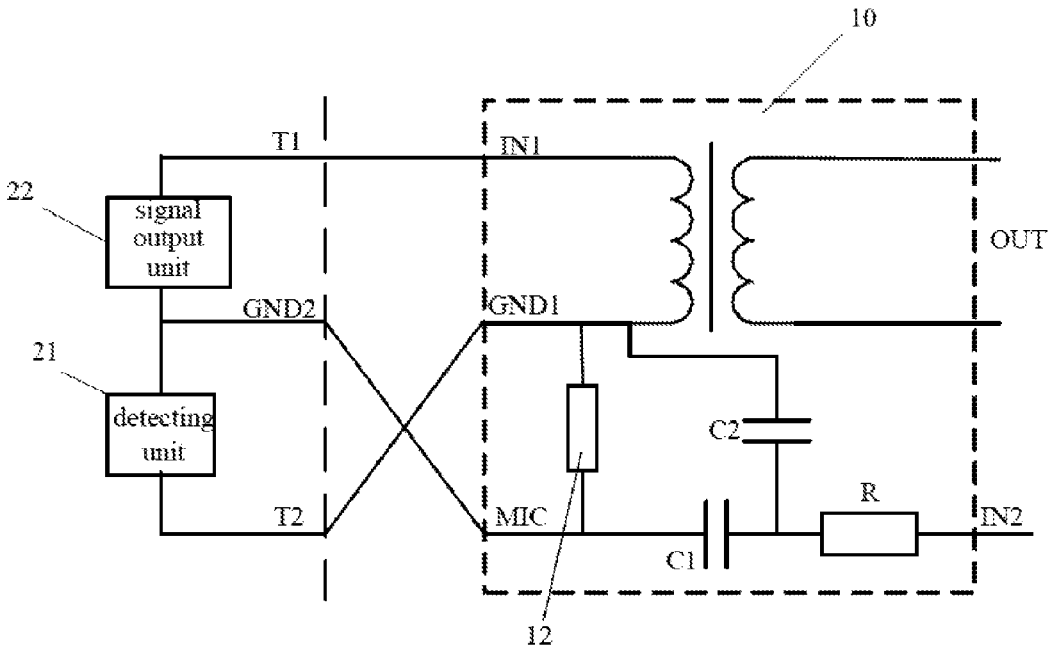
FIG. 8 is a schematic diagram of an interface detecting system of an audio signal adapter device according to another embodiment of the present disclosure.

Referring to FIG. 8, when the ground pin GND2 of the detecting interface is connected with a microphone pin MIC of the audio signal adapter device and the detecting pin T2 of the detecting interface is connected with the ground pin GND1 of the audio signal adapter device, the signal output pin T1 of the detecting interface outputs a detecting signal to the audio signal receiving pin IN1 of the audio signal adapter device. The detecting signal flows to the ground pin GND1 of the detecting interface via the impedance equivalent part of the audio signal amplifying circuit of the audio signal adapter device 10. With a voltage-dividing effect of the impedance equivalent part of the audio signal amplifying circuit and an impedance circuit 12, the ground pin GND1 of the audio signal adapter device outputs a signal to the detecting pin T2 of the detecting interface, and thus the detecting unit 21 may receive the detecting signal, which indicates that the first interface of the audio signal adapter device mismatches the detecting interface.

Embodiment 2

Figure 9:
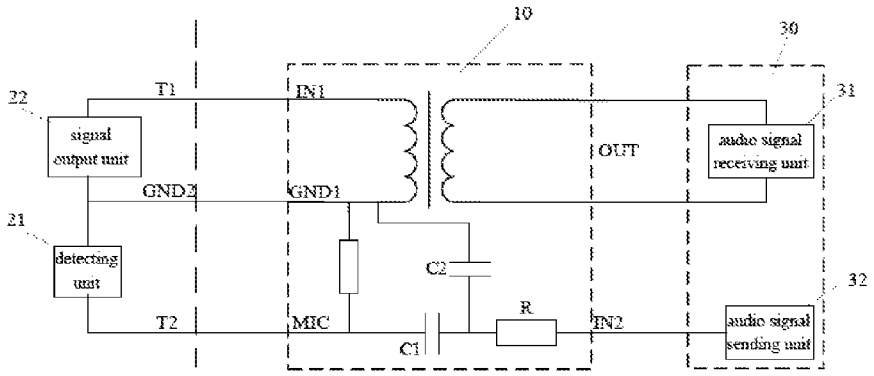
FIG. 9 is a schematic diagram of an interface detecting system of an audio signal adapter device according to yet another embodiment of the present disclosure.

As shown in FIG. 9, the interface detecting system of the audio signal adapter device further comprises a master control chip 30 coupled with the audio signal adapter device 10. The master control chip 30 comprises an audio signal receiving unit 31 and an audio signal sending unit 32. The audio signal receiving unit 31 is coupled with the audio signal output pin OUT of the audio signal adapter device 10. The audio signal sending unit 32 is coupled with the audio signal input pin IN2 of the audio signal adapter device 10.

The audio signal sending unit 32 sends signals to the audio signal adapter device, or the audio signal receiving unit 31 receives the signals from the audio signal adapter device, thus realizing an uplink or downlink transmission of an audio signal of the audio signal adapter device.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. An audio signal adapter device, comprising: a first interface, a second interface, an audio signal amplifying circuit and an impedance circuit, wherein the first interface comprises an audio signal receiving pin, a microphone pin and a ground pin, the second interface comprises an audio signal output pin, the audio signal amplifying circuit is configured to amplify an audio signal received by the audio signal receiving pin and to output the amplified audio signal to the audio signal output pin;

the audio signal received by the audio signal receiving pin flows to the microphone pin or the ground pin via an impedance equivalent part of the audio signal amplifying circuit; and the impedance circuit is coupled between the microphone pin and the ground pin.

2. The device according to claim 1, wherein the second interface further comprises an audio signal input pin.

3. The device according to claim 2, further comprising a first circuit and a second circuit, wherein the first circuit is coupled between the microphone pin and the audio signal input pin, the second circuit is coupled between the ground pin and the audio signal input pin, and the first circuit and the second circuit are attenuation circuits for each other.

4. The device according to claim 3, wherein the first circuit is a filter circuit or a voltage-dividing circuit;

the second circuit is a filter circuit or a voltage-dividing circuit.

5. The device according to claim 4, wherein the first circuit and the second circuit are symmetric attenuation circuits or asymmetric attenuation circuits for each other.

6. The device according to claim 1, wherein the audio signal amplifying circuit comprises at least one selected from a group consisting of: a transformer, a resistor and an operational amplifier connected in parallel, an inductor and an operational amplifier connected in parallel, a resistor and a comparator connected in parallel, and an inductor and a comparator connected in parallel.

7. A system comprising an audio signal adapter device and a master control chip, wherein the audio signal adapter device comprises a first interface, a second interface, an audio signal amplifying circuit and an impedance circuit, the first interface comprises an audio signal receiving pin, a microphone pin and a ground pin, the second interface comprises an audio signal output pin, the audio signal amplifying circuit is configured to amplify an audio signal received by the audio signal receiving pin and to output the amplified audio signal to the audio signal output pin;

the audio signal received by the audio signal receiving pin flows to the microphone pin or the ground pin via an impedance equivalent part of the audio signal amplifying circuit;

the impedance circuit is coupled between the microphone pin and the ground pin;

the second interface further comprises an audio signal input pin;

the master control chip comprises an audio signal receiving unit and an audio signal sending unit;

the audio signal receiving unit is coupled with the audio signal output pin of the audio signal adapter device; and the audio signal sending unit is coupled with the audio signal input pin of the audio signal adapter device.

8. An interface detecting system of an audio signal adapter device, comprising an audio signal adapter device and a detecting device, wherein the audio signal adapter device comprises a first interface, a second interface, an audio signal amplifying circuit and an impedance circuit;

the first interface comprises an audio signal receiving pin, a microphone pin and a ground pin, the second interface comprises an audio signal output pin, the audio signal amplifying circuit is configured to amplify an audio signal received by the audio signal receiving pin and to output the amplified audio signal to the audio signal output pin;

the audio signal received by the audio signal receiving pin flows to the microphone pin or the ground pin via an impedance equivalent part of the audio signal amplifying circuit;

the impedance circuit is coupled between the microphone pin and the ground pin;

the detecting device comprises a detecting interface and a detecting unit;

the detecting interface comprises a detecting signal output pin, a ground pin and a detecting pin, and adapts to the first interface of the audio signal adapter device so as to detect the first interface; and when the ground pin of the detecting interface is coupled with the microphone pin of the audio signal adapter device, the detecting unit is configured to determine a mismatch between the first interface and the detecting interface according to an analog signal received by the detecting pin.

9. The system according to claim 8, further comprising a master control chip coupled with the audio signal adapter device, wherein the master control chip comprises an audio signal receiving unit and an audio signal sending unit;

the audio signal receiving unit is coupled with the audio signal output pin of the audio signal adapter device; and the audio signal sending unit is coupled with the audio signal input pin of the audio signal adapter device.

10. The system according to claim 7, further comprising a first circuit and a second circuit, wherein the first circuit is coupled between the microphone pin and the audio signal input pin, the second circuit is coupled between the ground pin and the audio signal input pin, and the first circuit and the second circuit are attenuation circuits for each other.

11. The system according to claim 10, wherein the first circuit is a filter circuit or a voltage-dividing circuit;

the second circuit is a filter circuit or a voltage-dividing circuit.

12. The system according to claim 11, wherein the first circuit and the second circuit are symmetric attenuation circuits or asymmetric attenuation circuits for each other.

13. The system according to claim 8, wherein the second interface further comprises an audio signal input pin.

14. The system according to claim 13, further comprising a first circuit and a second circuit, wherein the first circuit is coupled between the microphone pin and the audio signal input pin, the second circuit is coupled between the ground pin and the audio signal input pin, and the first circuit and the second circuit are attenuation circuits for each other.

15. The system according to claim 14, wherein the first circuit is a filter circuit or a voltage-dividing circuit;

the second circuit is a filter circuit or a voltage-dividing circuit.

16. The system according to claim 15, wherein the first circuit and the second circuit are symmetric attenuation circuits or asymmetric attenuation circuits for each other.

17. The system according to claim 8, wherein the audio signal amplifying circuit comprises at least one selected from a group consisting of: a transformer, a resistor and an operational amplifier connected in parallel, an inductor and an operational amplifier connected in parallel, a resistor and a comparator connected in parallel, and an inductor and a comparator connected in parallel.

* * * * *